United States Patent [19]

Vrolyk

[11] Patent Number: 4,498,531

[45] Date of Patent: Feb. 12, 1985

[54] EMISSION CONTROLLER FOR INDIRECT FIRED DOWNHOLE STEAM GENERATORS

[75] Inventor: John J. Vrolyk, Northridge, Calif.

[73] Assignee: Rockwell International Corporation, El Segundo, Calif.

[21] Appl. No.: 432,179

[22] Filed: Oct. 1, 1982

[51] Int. Cl.[3] ..... E21B 43/24

[52] U.S. Cl. ..... 166/59; 423/242

[58] Field of Search ..... 166/57, 59; 423/242 A; 422/168, 172

[56] References Cited

U.S. PATENT DOCUMENTS

| | | | |
|---|---|---|---|
| 3,127,936 | 4/1964 | Eurenius | 166/59 |
| 3,181,613 | 5/1965 | Krueger | 166/59 |
| 3,918,521 | 11/1975 | Snavely, Jr. et al. | 166/272 |
| 4,223,735 | 9/1980 | Caldwell, Jr. et al. | 423/242 A |
| 4,267,156 | 5/1981 | Dauerman et al. | 423/242 A |
| 4,377,557 | 3/1983 | Lowell | 423/242 A |

FOREIGN PATENT DOCUMENTS

| | | | |
|---|---|---|---|
| 0048109 | 9/1981 | Japan | 422/168 |

*Primary Examiner*—Stephen J. Novosad
*Assistant Examiner*—William P. Neuder
*Attorney, Agent, or Firm*—H. Fredrick Hamann; Harry B. Field

[57] ABSTRACT

The present invention provides an indirect downhole steam generator system comprising a downhole combustor, a well casing which provides a flue for the exhaust gases of the downhole combustor, and one or more aerosol nozzles situated within the exhaust flue of the well casing for injecting an aerosol limestone dust into the exhaust gases of the combustor as the exhaust gases travel up the flue.

10 Claims, 7 Drawing Figures

EMISSION CONTROLLER FOR INDIRECT FIRED DOWNHOLE STEAM GENERATORS

FIELD OF THE INVENTION

This invention relates generally to means for cleaning flue gases and particularly to means for controlling flue emissions from indirect downhole steam generators.

BACKGROUND OF THE INVENTION AND DESCRIPTION OF THE PRIOR ART

Downhole steam generators have been found to be an expedient means for injecting large quantities of high quality steam directly from the base of oil drilling wells for the purpose of stimulating petroleum production. Indirectly fired steam generators such as is shown in U.S. Pat. No. 4,243,098 to Meeks et al form steam within a heat exchanger situated in heat transfer relationship to a downhole combustor whereupon the system ejects the steam into the intended petroleum formation while redirecting the exhaust gases of the combustor to pass upwardly along a flue for discharge into the atmosphere at the well head. In contrast, direct fired steam generators such as the one described in U.S. Pat. No. 4,336,839 to Wagner et al inject a mixture of exhast gases and steam from a downhole combustor directly into the underground formation.

The indirect downhole steam generator has many advantages over the direct type, one being that the combustion chamber of the indirect type can be operated at much lower pressures because the indirect-type keeps the exhaust gases of the combustor separate from the steam. As a result, the pumps for delivering the fuel and oxidizer to the indirect downhole steam generator are smaller and less complicated than those of the direct type.

However, the combustor exhaust gases of the indirect downhole steam generator most often comprise significant amounts of nitrogen oxides, sulfur oxides and related acids and acid anhydrides. These highly corrosive and toxic substances chemically attack the walls of the exhaust flue and present significant problems in regard to air pollution. The corrosion in the well casing becomes especially acute at and beyond the point along the length of the well casing where the exhaust gases become sufficiently cooled to allow water vapors and acid vapors contained therein to condense. This water becomes highly acidic and clings to the interior walls of the well casing and to anything contained therein.

In regard to the problem of air pollution, the concentrations of nitrogen oxides and sulfur oxides in the exhaust of the indirect systems often far exceed allowable environment standards. This problem is especially acute when the combustor is fired with low cost, high-sulfur content fuels.

U.S. Pat. No. 3,918,521 to Snavely, Jr. et al describes a system for cleaning sulfur oxides from the flue gases of an above-hole steam generator wherein the flue gases of the combustor and a flow of treated alkaline water are directed in counterflow directions within an above-hole emission scrubber vessel, the water being then collected and directed to a settling tank for the removal of the calcium sulfite contained therein. The system pretreats the alkaline water with an oxidation-inhibitor to prevent the oxidation of the calcium sulfite to calcium sulfate. As is evident from the disclosure, these types of systems requires the emplacement of a substantial number of different types of complicated machinery at every well head, which requirement makes such systems costly both to acquire and to operate. Consequently they are economically unfeasible and unsuitable for wide-spread use.

OBJECTS OF THE INVENTION

An immediate object of the present invention is to provide a downhole steam generator system which can cleanse sulfur oxides and other exhaust effluents without a plethora of complicated machinery at the well head.

Another object of the present invention is to provide a downhole steam generator which can burn low grade, high sulphur content fuels without causing air pollution.

Yet another object of the present invention is to provide a downhole steam generator which efficiently controls the emissions of sulfur oxide from the downhole steam generator but without an emission scrubber.

Still another object of the present invention is to provide a downhole steam generator which includes means for controlling emissions of sulfur oxides which is both economical and effective.

Yet another object of the present invention is to produce petroleum from a petroleum-bearing formation without ejecting oxides of sulphur into either the formation or the atmosphere.

Still another object of the present invention is to provide a means for arresting corrosion in the well casing of indirect downhole steam generators while also alleviating the pollution problems of the combustor exhaust.

SUMMARY OF THE INVENTION

These and other advantages are accomplished by the present invention which provides an indirect downhole steam generator system comprising a downhole combustor, a well casing which provides a flue for the exhaust gases of the downhole combustor, and one or more aerosol nozzles situated within the exhaust flue of the well casing for injecting an aerosol of limestone dust into the exhaust gases of the combustor as the exhaust gases travel up the flue. During such time, the exhaust gases mix with the aerosol and so allow the suspended limestone particles to serve as situses for the condensation of water vapor and to there react with the oxides of sulfur and other acidic pollutants to form a dispersed waste material. The dispersed waste material is collected for disposal by an appropriate filtering means. In similar fashion, the limestone dust also serves to neutralize aicds in the condensation on the exhaust flue and the well casing to thereby abate corrosion.

BRIEF DESCRIPTION OF THE DRAWINGS

Other objects, advantages and novel features of the present invention will become apparent from the following detailed description of the invention when considered in conjunction with the accompanying drawing.

FIG. 2*a.* is cross-sectional view taken at line A—A in FIG. 2;

FIG. 2*b.* is a cross-sectional view taken at line B—B of FIG. 2;

FIG. 3*a*. is a cross-sectional view taken at the line A—A in FIG. 3; and

FIG. 3*b*. is a detailed view of injector housing of FIG. 3, but with angulated orifices through the partition element of the housing.

DESCRIPTION OF THE PREFERRED EMBODIMENTS

Figure 1:
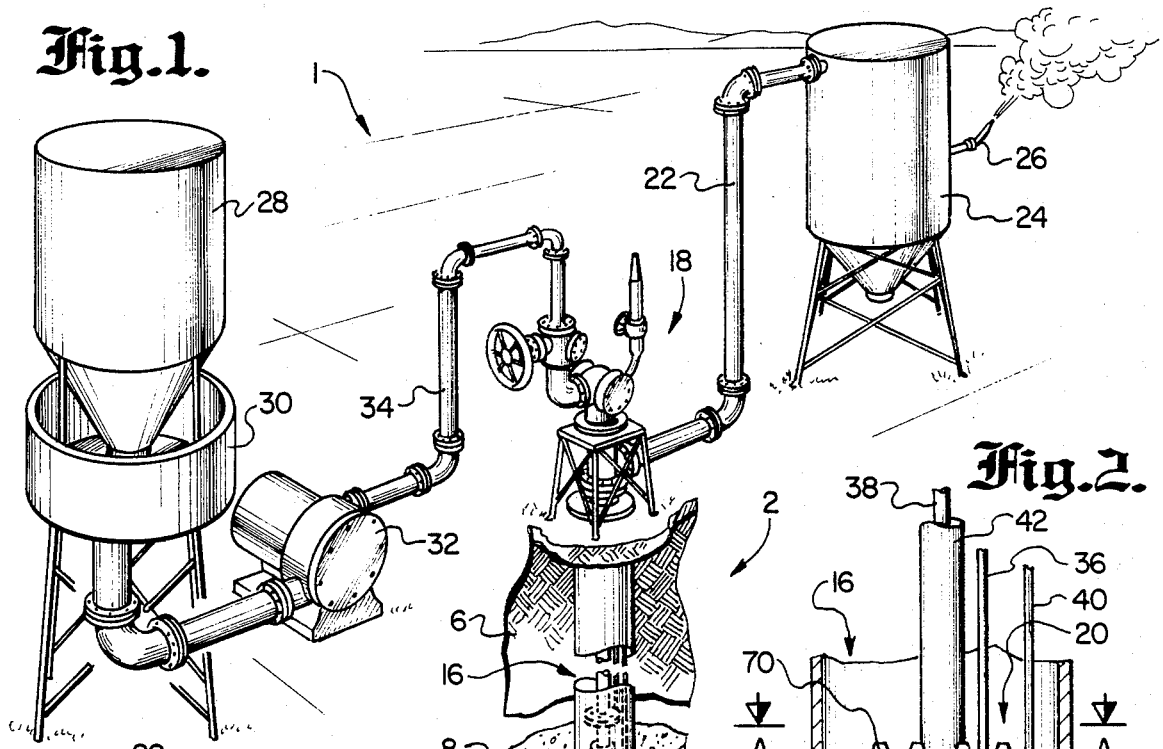
FIG. 1 is a schematic diagram of the indirect downhole steam generator system comprising the present invention.

The same elements or parts throughout the figures of the drawing are designated by the same reference characters, while equivalent elements bear a prime designation.

Referring to FIG. 1, the present invention provides an indirect downhole steam generator system 1 generally comprising an indirectly-fired steam generator 2 located at base 4 of well casing 6, which steam generator comprises a combustor 8 and a heat exchanger 10 situated in a heat transfer relationship with combustor 8. A high volume rate of superheated steam is generated in heat exchanger 10 which steam is discharged through nozzle 12 into petroleum-bearing formation 14 so that useable oil might be more readily recovered. Exhaust gases created in combustor 8 of steam generator 2 escape up exhaust flue 16 in well casing 6 to arrive at well head 18. However, because sulfur oxides, nitrogen oxides and other acid anhydrides comprise a significant part of these exhaust gases, there is provided within exhaust flue 16 in proximity to steam generator 2 an aerosol nozzle assembly 20 for injecting a suspension containing lime-reactants into the exhaust gases of combustor 8.

Figure 2:
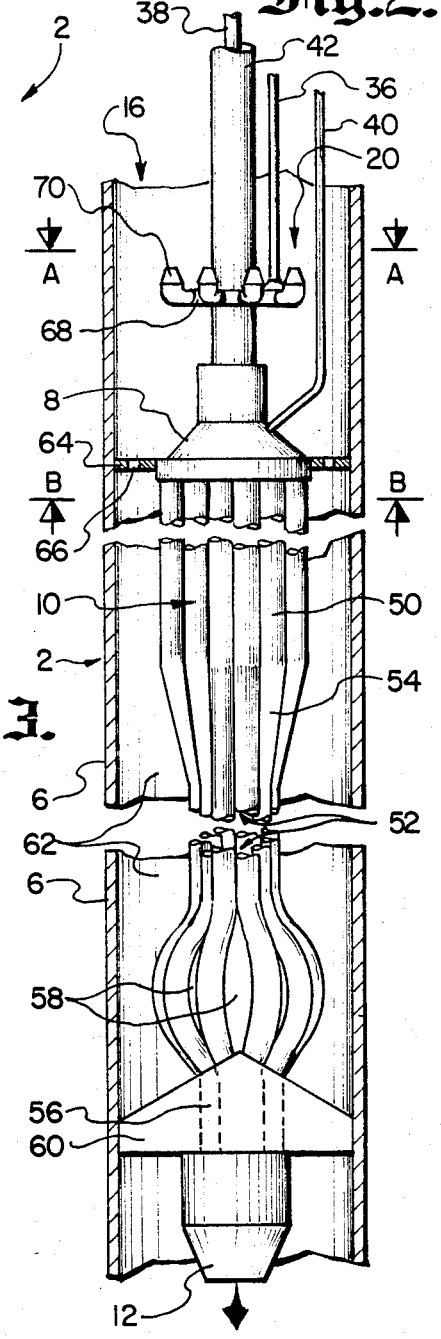
FIG. 2 is cross-sectional view of the preferred embodiment of the present invention taken at the base of the well casing shown in FIG. 1.
Figure 2:
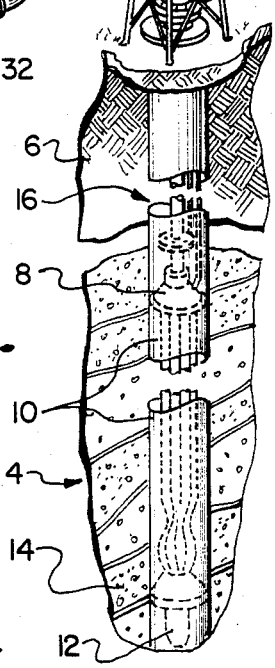
Figure 2:
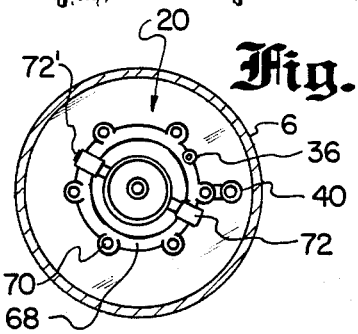
Figure 2:
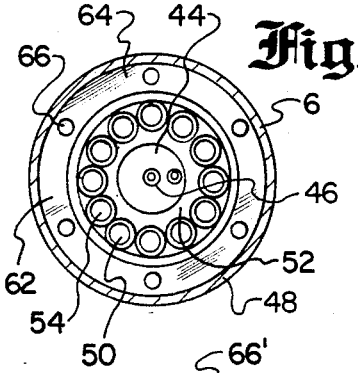

Preferably, the lime suspension comprises a dry aerosol of air and limestone dust, but can in the alternative comprise a slurry of water and finely ground limestone. Because of the extreme length of exhaust flue 16 which usually ranges between 500 and 5000 feet and because of the highly turbulent nature of the exhaust gases as they travel up exhaust flue 16, the limestone suspension mixes thoroughly with the exhaust gases of combustor 8. This thorough mixing allows the limestone-reactants to react with the oxides of sulfur and the other pollutants in the exhaust gases to form a dispersed waste material which is carried up exhaust flue 16 to well head 18. The dispersed waste material primarily consists of calcium sulfite ($CaSO_3$) and calcium sulfate ($CaSO_4$), the latter occuring when the exhaust gases contain residual oxygen. At well head 18, the exhaust gases and dispersed waste material are directed via line 22 to a fly ash filter for collection of the dispersed waste material before discharge of the exhaust gases into the atmosphere via exhaust stack 26. Also situated at well head 18 is limestone storage tank 28 and mixer 30 for preparing the limestone suspension and pump 32 for providing sufficient pressure to force limestone suspension through line 34 and down feeder tube 36. Also extending downwardly from well head 18 to steam generator 2 are fuel duct 38, oxidizer (air) duct 40 and water duct 42, as is shown in FIG. 2. The various sources of fuel, oxidizer and water and their connections to well head 18 are omitted from FIG. 1, but their construction lies well within the ordinary design.

Referring now to FIGS. 2, 2*a*. and 2*b*., fuel duct 28 and oxidizer duct 40 lead into combustor head 44 of combustor 8 for supplying fuel and oxidizer to fuel injector port 46 and oxidizer port 48, respectively, so that combustion can be initiated and maintained as long as desired. Heat exchanger 10 comprising tube bundle 50 encloses an elongated cylindrical cavity which serves as combustion chamber 52 of combustor 8. A flow of water is directed from well head 18 down water pipe 42, then through internal passages in combustor head 44 (not shown) to each of the individual elements of tube bundle 50. As the flow of water continues down the individual elements 54, heat from the combustion process in combustion chamber 52 converts the water into steam and then superheats the steam. The superheated steam then continues through channels 56 leading to steam nozzle 12 wherefrom it is discharged into petroleum formation 14.

The combustion process occurs along almost the entire length of combustion chamber 52 and the exhaust gases generated by the combustion process are driven down the entire length of combustion chamber 52 until they encounters exhaust ports 58 and exhaust flow guide 60. Exhaust ports formed between individual elements 54 of tube bundle 50 allow the exhaust gases to escape from combustion chamber 52. Exhaust flow guide 60 redirects the exhaust gases so that they travel up exhaust annulus 62. Channels 56 through exhaust flow guide 60 allow the flow of water in individual elements 54 to continue to nozzle 12. As the exhaust gases flow up exhaust annulus 62 they encounter partition 64 having orifices 66. Partition 64 serves as a means for imparting the desired back pressure to the exhaust gases of combustor 8. Once through orifices 66, the exhaust gases continue to flow up exhaust flue 16 to well head 18 in a characteristically turbulent fashion.

Situated within exhaust flue 16, preferably in close proximate location to steam generator 2, is aerosol nozzle assembly 20 comprising tubular ring 68 and injectors 70 which injectors are pointed in a substantially upwards direction. Tubular ring 68 receives feeder tube 36 and is held in place by brackets 72 and 72' which brackets are welded to the exterior of water pipe 42. It is to be understood that ring 68 not only provides support to injectors 70 but also serves to distribute the flow of limestone-suspension from feeder tube 36 to each of the injectors 70. Although the aerosol injector assembly is herein described as comprising a ring and a plurality of injectors, in some instances a single injector 70 might be preferred in which case ring 68 would be omitted and single bracket 72 would be used for support.

As previously mentioned, the exhaust gases travelling up exhaust flue 16 contain significant amounts of sulfur oxides, nitrogen oxides and other acids and acid anhydrides. In systems of the prior art, these acids would cause severe corrosion in the well casing, especially beyond the point along the exhaust flue 16 where water droplets could form as a result of condensation. However, under the present invention, the injected limestone dust particles serve as the situses for this condensation and thus allow for neutralizing reactions to take place in the water droplets between the limestone particle ($CaCO_3$) and the acids. These neutralizing reactions lead to the formation of waste material which is carried along in a dispersed state by the remainder of the exhaust gases to well head 18, whereat the dispersed waste material and exhaust gases are directed via line 22 to a fly ash filter 24 or other conventional system for capture of the waste material. The aforementioned neutralizing reactions occur either in solution within condensed water droplets or upon the surface of the limestone dust particles where minute bits of water and acids accumulate. The primary neutralizing reaction is given by the following formula:

$$CaCO_3 + H_2SO_3 \div H_2O + CO_2 + CaSO_3$$

The resultant calcium sulfite ($CaSO_3$) constitutes a significant part of the dispersed waste material carried up exhaust flue 16. However, if there is excess oxygen in the exhaust gases some of the calcium sulfite oxidizes to form calcium sulfate ($CaSO_4$). Other acidic gases such as $NO_2$ will react in a similar manner and unburned hydrocarbons will also tend to become absorbed on the surface of the fine limestone dust particles. The use of the dry aerosol of air and limestone dust is advantageous in that it minimizes corrosion-causing condensation within well casing 6 because it cools the exhaust gas far less than would a wet aerosol and because it does not introduce additional water vapor to the exhaust gases. Moreover, the minute limestone dust particles scour the surfaces within well casing 6 of foreign matter, including water droplets, as they are thrown about in the turbulence of the exhaust gases.

Figure 3:
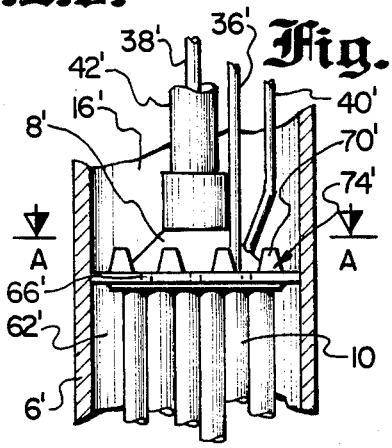
FIG. 3 is a cross-sectional view of an alternate embodiment of the present invention taken at the base of the well casing shown in FIG. 1.
Figure 3:
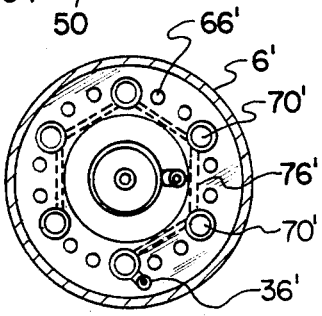
Figure 3:
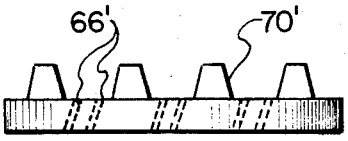

FIGS. 3 and 3*a.* illustrate an alternate embodiment of the present invention wherein element 74' is provided which serves the functions of both ring 68 and partition 64 in FIG. 2. Like ring 68, element 74' supports injectors 70', receives feeder tube 36 and provides internal channels 56' for distributing limestone-suspension to each of injectors 70'. Like partition 64, element 74' extends across annulus 62' and provides orifices 66' so that the desired back pressure is created in the exhaust gases of combustor 8'. In FIG. 3*b.*, orifices 66' are at an angle with respect to the axis of exhaust flue 16' to impart a swirl to the exhaust gases of combustor 8' for the purpose of further improving the mixing of exhaust gases with the limestone-aerosol. The same effect is most readily achieved in the preferred embodiment by similar modification of partition 64 in FIG. 2.

Although there are significant advantages of using a dry aerosol of air and limestone dust in the present invention, the same results can be achieved by the use of a slurry prepared from water and very finely ground limestone. The small amount of water in the slurry in part evaporates into the exhaust gases, leaving a very fine aerosol which is reactive to acid and acid anhydrides in the exhaust gases. For example, sulfur dioxide in the flue gas reacts with the limestone particle surface to form the solid, $CaSO_3$, which sticks to the particle surface. This finely divided material is kept in suspension and is carried to the surface by the relatively fast moving and turbulent flue gases. Once above ground, the flue gases are conducted into a pulse-get fabric filter where the dry solids are separated from the flue gas and the clean flue gases are released into the atmosphere.

If the quantity of water in the slurry is further increased an aerosol is produced which remains as small water droplets which are carried all the way up exhaust flue 16 to the surface. Above ground, these droplets are separated from the flue gases by demisters or centrifugal separators which are well known in the art, the waste material being water slurry which must be disposed of by appropriate means.

It is also contemplated that equivalent aerosols and slurries composed of other alkaline reactants could be used in accordance with present invention, some examples being the use of slaked lime ($Ca(OH)_2$), lime ($CaO$), and other limestone-type materials.

Obviously, many modifications and variations of the present invention are possible in light of the above teachings. It is therefore to be understood that, within the scope of the appended claims, the invention may be practiced otherwise than as specifically described.

What is claimed and desired to be secured by the Letter Patent of the United States is:

1. An indirect downhole steam generator system comprising:

an indirectly fired downhole steam generator;

a well casing leading from a well head to said downhole steam generator, said well casing comprising a flue for directing a flow of exhaust gases from said downhole steam generator to said well head, said flow of exhaust gases containing pollutants;

an injector located within said well casing for injecting a suspension containing an alkaline reactant into said flow of exhaust gases; said suspension being carried along and mixed within said flow of exhaust gases and said alkaline reactant reacting with said pollutants to form a dispersed waste material;

means for supplying said suspension to said injector; and means for collecting said waste material at said well head for removal.

2. The downhole steam generator system as claimed in claim 1 wherein said system further comprises a means for creating backpressure in said flow of exhaust gases.

3. The downhole steam generator system as claimed in claim 2 wherein said means for creating backpressure is a partition positioned across said flue, said partition having at least one passage therethrough to favorably constrict said flow of exhaust gases.

4. The downhole steam generator system as claimed in claim 3 wherein said passage is skewed to promote mixing of said suspension and said flow of exhaust gases.

5. The downhole steam generator system as claimed in claim 3 or 4 wherein said injector and said partition are integral.

6. The downhole steam generator system as claimed in claim 3 wherein said reactant suspension is a dry aerosol of air and limestone dust.

7. The downhole steam generator system as claimed in claim 6 wherein said waste material collecting means is a fly ash filter.

8. The downhole steam generator system as claimed in claim 3 wherein said reactant suspension is a limestone slurry.

9. The downhole steam generator system as claimed in claim 8 wherein said waste material collecting means is centrifugal separator.

10. The downhole steam generator system as claimed in claim 8 wherein said waste material collecting means is a demister.

* * * * *

UNITED STATES PATENT AND TRADEMARK OFFICE

CERTIFICATE OF CORRECTION

PATENT NO. : 4,498,531

DATED : Feb. 12, 1985

INVENTOR(S) : John J. Vrolyk

It is certified that error appears in the above-identified patent and that said Letters Patent are hereby corrected as shown below:

Column 6, line 48, after the word "said", insert --alkaline--.

Column 6, line 54, after the word "said", insert --alkaline--.

Signed and Sealed this

*Twenty-seventh* Day of *August 1985*

[SEAL]

*Attest:*

DONALD J. QUIGG

*Attesting Officer* *Acting Commissioner of Patents and Trademarks*